US009120658B2

(12) United States Patent
Kaneko et al.

(10) Patent No.: US 9,120,658 B2
(45) Date of Patent: Sep. 1, 2015

(54) FORKLIFT AND CONTROL METHOD OF FORKLIFT

(71) Applicant: Komatsu Ltd., Tokyo (JP)

(72) Inventors: Shinji Kaneko, Oyama (JP); Taishi Oiwa, Naka-gun (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 14/369,769

(22) PCT Filed: Dec. 27, 2013

(86) PCT No.: PCT/JP2013/085265

§ 371 (c)(1),
(2) Date: Jun. 30, 2014

(65) Prior Publication Data

US 2015/0183625 A1 Jul. 2, 2015

(51) Int. Cl.
*B66F 9/075* (2006.01)

(52) U.S. Cl.
CPC ..... *B66F 9/07572* (2013.01)

(58) Field of Classification Search
USPC ..... 701/22
See application file for complete search history.

(56) References Cited

U.S. PATENT DOCUMENTS

| | | | | |
|---|---|---|---|---|
| 7,512,471 | B2 * | 3/2009 | Nakamura et al. | 701/50 |
| 7,524,268 | B2 * | 4/2009 | Oka et al. | 477/169 |
| 7,543,448 | B2 * | 6/2009 | Nakamura et al. | 60/434 |
| 7,810,323 | B2 * | 10/2010 | Iwamoto | 60/431 |
| 8,056,331 | B2 * | 11/2011 | Kakizawa et al. | 60/431 |
| 8,135,531 | B2 * | 3/2012 | Zhao et al. | 701/93 |
| 2004/0088103 | A1 * | 5/2004 | Itow et al. | 701/110 |
| 2004/0249538 | A1 * | 12/2004 | Osaki et al. | 701/50 |
| 2008/0213075 | A1 * | 9/2008 | Sjogren et al. | 414/700 |
| 2009/0111655 | A1 * | 4/2009 | Hatanaka | 477/218 |
| 2009/0132134 | A1 * | 5/2009 | Chen et al. | 701/53 |
| 2011/0320067 | A1 * | 12/2011 | Ishikawa et al. | 701/2 |
| 2012/0263604 | A1 * | 10/2012 | Jung | 417/1 |
| 2012/0285157 | A1 * | 11/2012 | Okano et al. | 60/445 |
| 2013/0218428 | A1 | 8/2013 | Onodera et al. | |
| 2013/0318952 | A1 * | 12/2013 | Park et al. | 60/327 |

FOREIGN PATENT DOCUMENTS

| | | | |
|---|---|---|---|
| JP | 02-275177 | A | 11/1990 |
| JP | 2000-213645 | A | 8/2000 |
| JP | 2012-057761 | A | 3/2012 |
| JP | 5144844 | B1 | 2/2013 |

OTHER PUBLICATIONS

International Search Report and Written Opinion dated Apr. 1, 2014, issued for PCT/JP2013/085265.
Decision of a Patent Grant mailed Dec. 9, 2014, issued for the corresponding Japanese patent application No. 2014-526021 and English translation thereof.

* cited by examiner

*Primary Examiner* — Thomas Tarcza
*Assistant Examiner* — Alex C Dunn
(74) *Attorney, Agent, or Firm* — Locke Lord LLP

(57) ABSTRACT

A forklift including a variable displacement HST pump driven by an engine, a hydraulic motor that forms a closed circuit with the HST pump therebetween and is driven by hydraulic oil discharged from the HST pump, and driving wheels driven by the hydraulic motor, wherein a control device calculates an inching rate corresponding to an operation amount of an inching pedal, and sets a lower limit of the inching rate to a value greater than 0, only in a state in which both of an accelerator pedal and the inching pedal are operated.

6 Claims, 7 Drawing Sheets

MP

| | Is1 | Is2 | ··· | Isn-1 | Isn |
|---|---|---|---|---|---|
| Tmx1 | Tia | Tib | ··· | 0 | 0 |
| Tmx2 | Tic | Tid | ··· | 0 | 0 |
| ⋮ | ⋮ | ⋮ | ⋮ | ⋮ | ⋮ |
| Tmxk | Tiw | Tix | ··· | 0 | 0 |

FORKLIFT AND CONTROL METHOD OF FORKLIFT

FIELD

The present invention relates to a forklift having a variable displacement hydraulic pump driven by an engine, and a hydraulic motor which forms a closed circuit with the hydraulic pump therebetween and is driven by hydraulic oil discharged from the hydraulic pump, and a method of controlling the forklift.

BACKGROUND

There are forklifts having a hydraulic driving device referred to as a hydro static transmission (HST) provided between an engine as a driving source and driving wheels. The hydraulic driving device includes a variable displacement traveling hydraulic pump driven by the engine, and a variable displacement hydraulic motor driven by hydraulic oil discharged from the traveling hydraulic pump in a main hydraulic circuit as a closed circuit, and allows a vehicle to travel by transmitting driving of the hydraulic motor to the driving wheels.

The forklift to which such a hydraulic driving device is applied also includes a working hydraulic pump driven by the engine, and drives a working machine by supplying the hydraulic oil to a working machine actuator from the working hydraulic pump. In such a forklift, inching control to increase and decrease an absorption torque of the traveling hydraulic pump is performed (for example, Patent Literature 1).

CITATION LIST

Patent Literature

Patent Literature 1: Japanese Patent Application Laid-open No. 2012-057761

SUMMARY

Technical Problem

Patent Literature 1 discloses seeking an overlap region where both an inching rate and a mechanical brake rate are 0% or more. In this way, since it is possible to generate driving force in the traveling hydraulic pump from a state in which braking force of a mechanical brake is generated, a time lag can be reduced when starting the forklift 1. However, the traveling hydraulic pump has hysteresis characteristic that passes through routes different from each other when a flow rate of the hydraulic oil decreases to 0 and when the hydraulic oil begins to be discharged and the flow rate increases, due to influence of internal friction or the like. For this reason, there is a possibility that stroke amounts of an inching pedal are different from each other at the time of stop and start of the forklift, and a position adjustment of a forklift using the inching pedal may be difficult.

An object of the invention is to suppress a change in the stroke when stepping on an inching pedal in the forklift including the HST.

Solution to Problem

According to the present invention, a forklift comprises: a variable displacement traveling hydraulic pump driven by an engine; a hydraulic motor that forms a closed circuit with the traveling hydraulic pump therebetween and is driven by hydraulic oil discharged from the traveling hydraulic pump; driving wheels driven by the hydraulic motor; an accelerator operation unit that increases and decreases an amount of fuel supplied to the engine; a target absorption torque calculation unit that calculates a target absorption torque of the traveling hydraulic pump or a target swash plate tilting angle of a swash plate included in the traveling hydraulic pump, based on an actual engine speed of the engine; an inching operation unit that operates an inching rate indicating a reduction ratio to a predetermined swash plate tilting angle of the traveling hydraulic pump; an inching rate calculation unit that calculates the inching rate corresponding to an operation amount of the inching operation unit, and sets a lower limit of the inching rate to a value greater than 0, only in a state in which both of the accelerator operation unit and the inching operation unit are operated; and an output control unit that outputs a corrected absorption torque command corresponding to a corrected absorption torque obtained by reducing the target absorption torque based on the inching rate or a corrected swash plate tilting angle command corresponding to a corrected swash plate tilting angle obtained by reducing the target swash plate tilting angle based on the inching rate to the traveling hydraulic pump.

In the present invention, it is preferable that the lower limit of the inching rate is determined based on a rotational speed of the engine, and a target absorption torque of the traveling hydraulic pump determined from the rotational speed of the engine.

In the present invention, it is preferable that the lower limit of the inching rate is determined depending on horsepower output from the engine or absorption horsepower of the traveling hydraulic pump.

According to the present invention, a method of controlling a forklift including a variable displacement traveling hydraulic pump driven by an engine, a hydraulic motor that forms a closed circuit with the traveling hydraulic pump therebetween and is driven by hydraulic oil discharged from the traveling hydraulic pump, driving wheels driven by the hydraulic motor, an accelerator operation unit that increases and decreases an amount of fuel supplied to the engine, and an inching operation unit that operates an inching rate indicating a reduction ratio to a predetermined swash plate tilting angle of the traveling hydraulic pump, the method comprises: calculating the inching rate corresponding to the operation amount of the inching operation unit, and setting a lower limit of the inching rate to a value greater than 0, only in a state in which both of the accelerator operation unit and the inching operation unit are operated; and outputting a corrected absorption torque command corresponding to a corrected absorption torque obtained by reducing a target absorption torque of the traveling hydraulic pump based on the inching rate, or a corrected swash plate tilting angle command corresponding to a corrected swash plate tilting angle obtained by reducing a target swash plate tilting angle of a swash plate included in the traveling hydraulic pump based on the inching rate, to the traveling hydraulic pump.

In the present invention, it is preferable that a lower limit of the inching rate is determined based on a rotational speed of the engine, and a target absorption torque of the traveling hydraulic pump determined from the rotational speed of the engine.

In the present invention, it is preferable that the lower limit of the inching rate is determined depending on horsepower output from the engine or absorption horsepower of the traveling hydraulic pump.

In a forklift including the HST according to the invention, it is possible to suppress a change in the stroke when stepping on an inching pedal.

DESCRIPTION OF EMBODIMENTS

Hereinafter, an embodiment for carrying out the invention will be described with reference to the accompanying drawings.

<Forklift>

Figure 1:
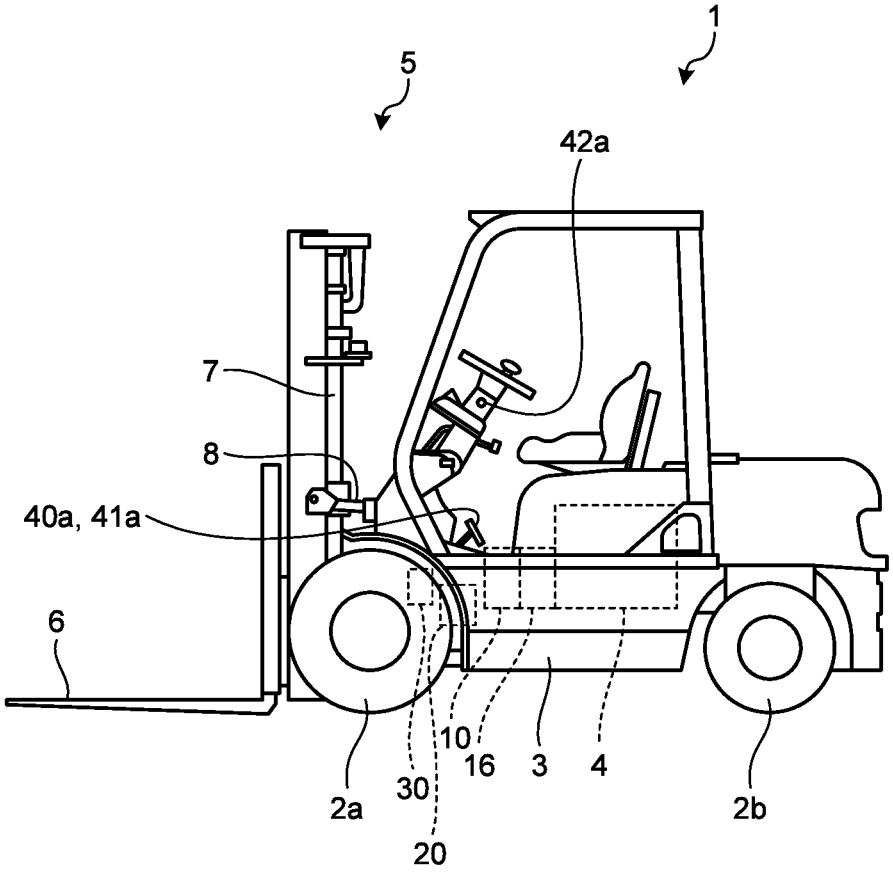
FIG. 1 is a diagram illustrating an overall configuration of a forklift according to an embodiment.
Figure 2:
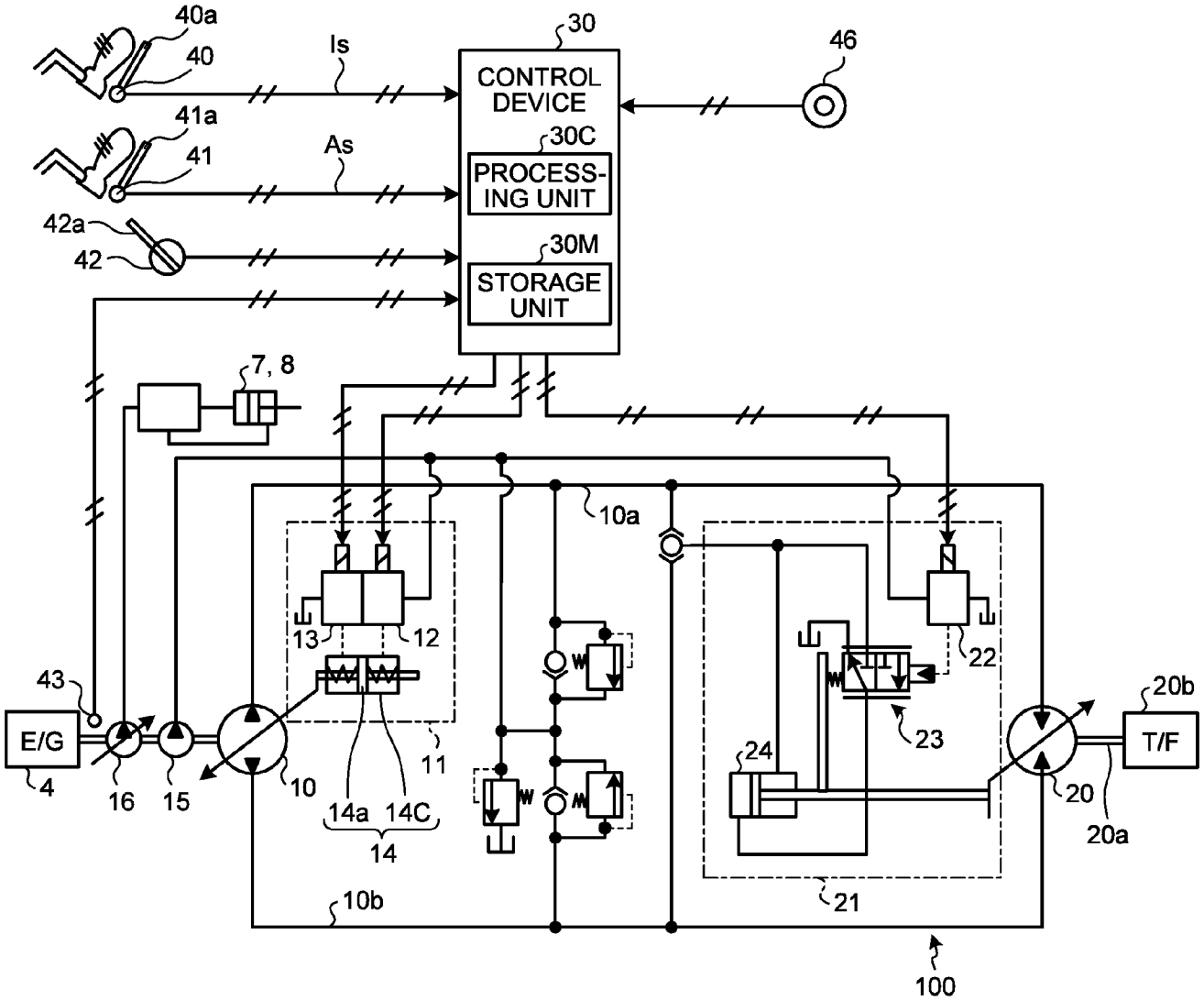
FIG. 2 is a block diagram illustrating a control system of the forklift illustrated in FIG. 1.

FIG. 1 is a diagram illustrating an overall configuration of a forklift 1 according to an embodiment. FIG. 2 is a block diagram illustrating a control system of the forklift illustrated in FIG. 1. The forklift 1 has a vehicle body 3 having driving wheels 2*a* and steering wheels 2*b*, and a working machine 5 provided in front of the vehicle body 3. The vehicle body 3 is provided with an engine 4 as an internal combustion engine, a variable displacement traveling hydraulic pump 10 configured to drive the engine 4 as a driving source, and a working machine hydraulic pump 16. The driving wheels 2*a* are driven by power of a hydraulic motor 20, by allowing the variable displacement traveling hydraulic pump 10 and a variable displacement hydraulic motor 20 to communicate with each other by a closed hydraulic circuit. In this way, the forklift 1 travels by the HST. In this embodiment, the traveling hydraulic pump 10 and the working machine hydraulic pump 16 have swash plates, and capacities thereof change by a change in a tilting angle of the swash plate.

The working machine 5 includes a lift cylinder 7 configured to raise and lower a fork 6, and a tilt cylinder 8 configured to tilt the fork 6. A driver's seat of the vehicle body 3 is provided with a forward-reverse lever 42*a*, an inching pedal (a brake pedal) 40*a* as an inching operation unit, an accelerator pedal 41*a* as an accelerator operating unit, and a working machine operation lever (not illustrated) including a lift lever and a tilt lever for operating the working machine 5. The inching pedal 40*a* operates an inching rate. The accelerator pedal 41*a* performs increase or decrease operation of an amount of fuel supplied to the engine 4. The inching pedal 40*a* and the accelerator pedal 41*a* are provided at a position where an operator of the forklift 1 is capable of performing stepping operation from the driver's seat. In FIG. 1, the inching pedal 40*a* and the accelerator pedal 41*a* are drawn in an overlapped state.

As illustrated in FIG. 2, the forklift 1 includes the traveling hydraulic pump 10 and the hydraulic motor 20 connected by hydraulic supply lines 10*a* and 10*b* of a main hydraulic circuit 100 serving as a closed circuit. The traveling hydraulic pump 10 (hereinafter, appropriately referred to as an HST pump 10) is a device that is driven by the engine 4 to discharge the hydraulic oil. In this embodiment, the HST pump 10 is, for example, a variable displacement pump capable of changing the capacity by changing the swash plate tilting angle.

The hydraulic motor 20 (hereinafter, appropriately referred to as HST motor 20) is driven by the hydraulic oil discharged from the HST pump 10. The hydraulic motor 20 is, for example, a variable displacement hydraulic motor capable of changing the capacity by changing the swash plate tilting angle. The HST motor 20 may also be a fixed displacement hydraulic motor. An output shaft 20*a* of the HST motor 20 is connected to the driving wheels 2*a* via a transfer 20*b*, and the HST motor 20 can drive the forklift 1 by rotationally driving the driving wheels 2*a*.

The HST motor 20 is capable of switching a rotation direction depending on a supply direction of the hydraulic oil from the HST pump 10. The rotation direction of the HST motor 20 is switched, which can move the forklift 1 forward or backward. In the following description, for convenience, it is assumed that when the hydraulic oil is supplied to the HST motor 20 from the hydraulic supply line 10*a*, the forklift 1 moves forward, and when the hydraulic oil is supplied to the HST motor 20 from the hydraulic supply line 10*b*, the forklift 1 moves backward.

The forklift 1 has a pump capacity setting unit 11, a motor capacity setting unit 21, and a charge pump 15. The pump capacity setting unit 11 is provided in the HST pump 10. The pump capacity setting unit 11 includes a forward pump electromagnetic proportional control valve 12, a reverse pump electromagnetic proportional control valve 13, and a pump capacity control cylinder 14. In the pump capacity setting unit 11, a command signal is applied to the forward pump electromagnetic proportional control valve 12 and the reverse pump electromagnetic proportional control valve 13 from a control device 30 which will be described below. In the pump capacity setting unit 11, the pump capacity control cylinder 14 is operated according to the command signal applied from the control device 30, the swash plate tilting angle of the HST pump 10 changes, and thus, the capacity thereof changes.

The pump capacity control cylinder 14 is configured so that a piston 14*a* is housed in a cylinder case 14C. Hydraulic oil is supplied to a space between the cylinder case 14C and the piston 14*a*, and thus the piston 14*a* reciprocates inside the cylinder case 14C. The piston 14*a* of the pump capacity control cylinder 14 is held at a neutral position in a state in which the swash plate tilting angle is 0. For this reason, even if the engine 4 turns, an amount of hydraulic oil discharged to the main hydraulic circuit 100 from the HS pump 10 is zero.

From the state in which the swash plate tilting angle of the HST pump 10 is 0, for example, when a command signal for increasing the capacity of the HST pump 10 is applied to the forward pump electromagnetic proportional control valve 12 from the control device 30, the pump control pressure is supplied to the pump capacity control cylinder 14 from the forward pump electromagnetic proportional control valve 12 according to the command signal. As a result, the piston 14*a* moves to the left side in FIG. 2. When the piston 14*a* of the pump capacity control cylinder 14 moves to the left side in FIG. 2, the swash plate of the HST pump 10 is tilted toward a direction of discharging the hydraulic oil to the hydraulic supply line 10*a* in conjunction with this operation.

As the pump control pressure from the forward pump electromagnetic proportional control valve 12 increases, the amount of movement of the piston 14*a* increases. For this reason, an amount of change in the tilting angle of the swash plate in the HST pump 10 also increases. That is, when the command signal is applied to the forward pump electromagnetic proportional control valve 12 from the control device 30, the pump control pressure depending on the command signal is supplied to the pump capacity control cylinder 14 from the forward pump electromagnetic proportional control valve 12. The pump capacity control cylinder 14 is operated by above-described pump control pressure, and thus the swash plate of the HST pump 10 is tilted so as to be able to discharge a predetermined amount of hydraulic oil to the hydraulic supply line 10*a*. As a result, if the engine 4 turns, the hydraulic oil is discharged to the hydraulic supply line 10*a* from the HST pump 10, and the HST motor 20 rotates in the forward direction.

In the above-described state, when a command signal for reducing the capacity of the HST pump 10 is applied to the forward pump electromagnetic proportional control valve 12 from the control device 30, the pump control pressure supplied to the pump capacity control cylinder 14 from the forward pump electromagnetic proportional control valve 12 depending on the command signal decreases. For this reason, the piston 14*a* of the pump capacity control cylinder 14 moves toward the neutral position. As a result, the swash plate tilting angle of the HST pump 10 decreases, and an amount of discharge of the hydraulic oil to the hydraulic supply line 10*a* from the HST pump 10 decreases.

When the control device 30 applies the command signal for increasing the capacity of the HST pump 10 to the reverse pump electromagnetic proportional control valve 13, the pump control pressure is supplied to the pump capacity control cylinder 14 from the reverse pump electromagnetic proportional control valve 13 depending on the command signal. Then, the piston 14*a* moves to the right side in FIG. 2. When the piston 14*a* of the pump capacity control cylinder 14 moves to the right side in FIG. 2, the swash plate of the HST pump 10 is tilted toward a direction of discharging the hydraulic oil to the hydraulic supply line 10*b* in conjunction with this operation.

As the pump control pressure supplied from the reverse pump electromagnetic proportional control valve 13 increases, an amount of movement of the piston 14*a* increases, and thus, an amount of change in the swash plate tilting angle of the HST pump 10 increases. That is, when the command signal is applied to the reverse pump electromagnetic proportional control valve 13 from the control device 30, the pump control pressure depending on the command signal is applied to the pump capacity control cylinder 14 from the reverse pump electromagnetic proportional control valve 13. Moreover, the swash plate of the HST pump 10 is tilted so as to be able to discharge a desired amount of hydraulic oil to the hydraulic supply line 10*b* by the operation of the pump capacity control cylinder 14. As a result, when the engine 4 turns, the hydraulic oil is discharged to the hydraulic supply line 10*b* from the HST pump 10, and the HST motor 20 rotates in the reverse direction.

When the command signal for reducing the capacity of the HST pump 10 is applied to the reverse pump electromagnetic proportional control valve 13 from the control device 30, the pump control pressure supplied to the pump capacity control cylinder 14 from the reverse pump electromagnetic proportional control valve 13 depending on the command signal decreases, and the piston 14*a* moves toward the neutral position. As a result, since the swash plate tilting angle of the HST pump 10 decreases, an amount of hydraulic oil discharged to the hydraulic supply line 10*b* from the HST pump 10 decreases.

The motor capacity setting unit 21 is provided in the HST motor 20. The motor capacity setting unit 21 includes a motor electromagnetic proportional control valve 22, a motor cylinder control valve 23, and a motor capacity control cylinder 24. In the motor capacity setting unit 21, when the command signal is applied to the motor electromagnetic proportional control valve 22 from the control device 30, the motor control pressure is supplied to the motor cylinder control valve 23 from the motor electromagnetic proportional control valve 22, and the motor capacity control cylinder 24 is operated. When the motor capacity control cylinder 24 is operated, the swash plate tilting angle of the HST motor 20 changes in conjunction with this operation. For this reason, the capacity of the HST motor 20 changes depending on a command signal from the control device 30. More specifically, the motor capacity setting unit 21 is configured so that as a motor control pressure supplied from the motor electromagnetic proportional control valve 22 increases, the swash plate tilting angle of the HST motor 20 decreases.

The charge pump 15 is driven by the engine 4. The charge pump 15 supplies the pump control pressure to the pump capacity control cylinder 14 via the forward pump electromagnetic proportional control valve 12 and the reverse pump electromagnetic proportional control valve 13 described above. Furthermore, the charge pump 15 has a function of supplying the motor control pressure to the motor cylinder control valve 23 via the motor electromagnetic proportional control valve 22.

In this embodiment, the engine 4 drives the working machine hydraulic pump 16 in addition to the HST pump 10. The working machine hydraulic pump 16 supplies the hydraulic oil to the lift cylinder 7 and the tilt cylinder 8 serving as working actuators for driving the working machine 5.

The forklift 1 includes an inching potentiometer (brake potentiometer) 40, an accelerator potentiometer 41, a forward-reverse lever switch 42, an engine speed sensor 43, and a vehicle speed sensor 46.

When the inching pedal (brake pedal) 40*a* is operated, the inching potentiometer 40 detects and outputs an operation amount thereof. The operation amount of the inching pedal 40*a* is an inching operation amount Is. The inching operation amount Is output from the inching potentiometer 40 is input to the control device 30.

Figure 3:
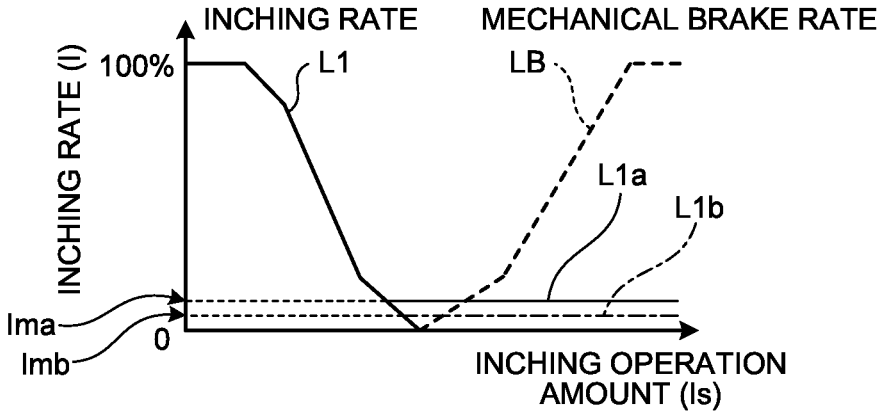
FIG. 3 is a diagram illustrating a change in an inching rate with respect to an inching operation amount.

FIG. 3 is a diagram illustrating a change in an inching rate I with respect to an inching operation amount Is. In FIG. 3, a vertical axis is an inching rate I and a horizontal axis is an inching operation amount Is. The inching rate I indicates a reduction ratio with respect to a predetermined swash plate tilting angle of the HST pump 10 and can be rephrased as a reduction ratio of the target absorption torque of the HST pump 10. When the inching rate I is 100%, the whole driving force of the engine 4 is transmitted to the HST pump 10, and when the inching rate I is 0%, the driving force of the engine 4 is not transmitted to the HST pump 10. In this embodiment, as indicated by a characteristic line L1 in FIG. 3, for example, when the inching operation amount Is detected by the inching potentiometer 40 is within a range of 0% to 50%, the inching rate I changes from 100% to 0%. In the inching operation amount Is within a range of 50% to 100%, as indicated by a characteristic line LB, a mechanical brake rate B illustrating effective conditions of a mechanical brake (not illustrated) changes from 0% to 100%.

In this embodiment, when both of the inching pedal 40*a* and the accelerator pedal 41*a* are operated, that is, stepped on, a lower limit of the inching rate I is maintained at a value greater than 0%. Hereinafter, the lower limit of the inching rate is also appropriately referred to as a minimum inching rate. A state in which both of the inching pedal 40*a* and the accelerator pedal 41*a* are operated is appropriately referred to as a simultaneous operation state. In an example illustrated in FIG. 3, in the simultaneous operation state, the inching rate is maintained in a minimum inching rate Ima or a minimum inching rate Imb represented by a straight line L1*a* or L1*b* parallel to the horizontal axis of FIG. 3. Hereinafter, when the inching rates are not distinguished from each other, they are also referred to as a minimum inching rate Im.

For example, if both of the inching pedal 40*a* and the accelerator pedal 41*a* are simultaneously stepped on, as a stepping amount of the inching pedal 40*a* increases, the inching operation amount Is increases. As the inching operation amount Is increases, the inching rate I decreases along the characteristic line L1. When the inching rate I decreases to the minimum inching rate Im, thereafter, even if the inching operation amount Is increases, the inching rate I is maintained in the minimum inching rate Im.

The minimum inching rate Im is determined based on a rotational speed sought from an engine speed of the engine 4 detected by the engine speed sensor 43 to be described later, and a target absorption torque of the HST pump 10 determined from the rotational speed. That is, the minimum inching rate Im changes depending on a change in output (horsepower) of the engine 4.

Figure 4:
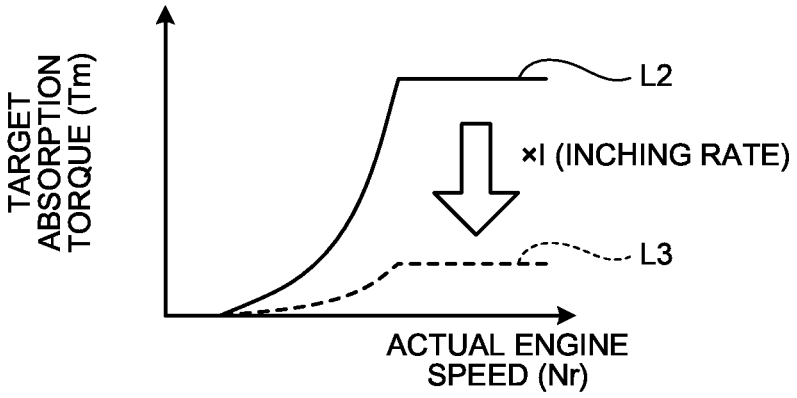
FIG. 4 is a diagram illustrating characteristic lines of a target absorption torque of an HST pump with respect to an actual engine speed.

FIG. 4 is a diagram illustrating a characteristic line L2 of a target absorption torque Tm of the HST pump 10 with respect to an actual engine speed Nr. The diagram indicates that the characteristic line L2 changes to, for example, the characteristic line L3 by multiplying the characteristic line L2 by the inching rate I. That is, the target absorption torque Tm of the HST pump 10 decreases by a decrease in the inching rate I. In this way, the inching rate I corresponds to the reduction rate of the target absorption torque Tm of the HST pump 10.

In this embodiment, operation in which an operator of the forklift 1 releases his foot from the inching pedal 40*a* to reduce or set the braking force due to the mechanical brake to 0 is referred to as "opening the brake". Closing the brake means that the operator of the forklift 1 steps on the inching pedal 40*a* to generate or increase the braking force due to the mechanical brake.

The accelerator potentiometer 41 outputs the operation amount As when the accelerator pedal 41*a* is operated. The operation amount As of the accelerator pedal 41*a* is also referred to as an accelerator opening As. The accelerator opening As output from the accelerator potentiometer 41 is input to the control device 30.

The forward-reverse lever switch 42 is a selection switch for inputting a traveling direction of the forklift 1. In this embodiment, the forward-reverse lever switch 42 is applied which is capable of selecting three directions of progress of a forward mode, a neutral mode, and a reverse mode by operation of the forward-reverse lever 42*a* provided at a position capable of being selectively operated from the driver's seat. Information indicating the traveling direction selected by the forward-reverse lever switch 42 is applied to the control device 30 as the selection information.

The engine speed sensor 43 detects the actual engine speed of the engine 4. The engine speed of the engine 4 detected by the engine speed sensor 43 is an actual engine speed Nr. Information indicating the actual engine speed Nr is input to the control device 30. In this embodiment, the actual engine speed Nr is treated as an actual engine speed Nr per unit time, that is, the actual engine rotational speed.

The control device 30 includes a processing unit 30C and a storage unit 30M. For example, the control device 30 is a device that includes a computer and executes various processes related to the control of the forklift 1. The processing unit 30C is configured by, for example, a combination of a central processing unit (CPU) and a memory. The processing unit 30C controls the operation of the main hydraulic circuit 100, by reading a computer program for controlling the main hydraulic circuit 100 stored in the storage unit 30M and executing the commands written therein. The storage unit 30M stores the data or the like required for the control of the above-described computer program and the main hydraulic circuit 100. The storage unit 30M is constituted by, for example, read only memory (ROM), a storage device or a combination thereof.

Various sensors such as the inching potentiometer 40, the accelerator potentiometer 41, the forward-reverse lever switch 42, the engine speed sensor 43, and the vehicle speed sensor 46 are electrically connected to the control device 30. Based on input signals from these various sensors, the control device 30 generates the command signals of the forward pump electromagnetic proportional control valve 12 and the reverse pump electromagnetic proportional control valve 13, and applies the generated command signals to the respective electromagnetic proportional control valves 12, 13, and 22.

<Characteristics When Inching Rate I Changes>

Figure 5:
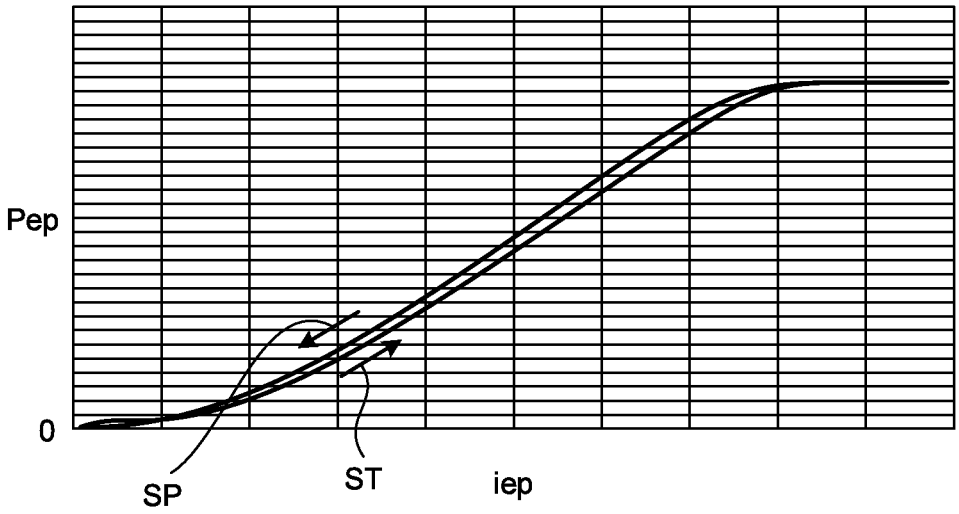
FIG. 5 is a diagram illustrating a relation between a command signal applied to a pump electromagnetic proportional control valve for controlling the HST pump and a piston chamber pressure of a pump capacity control cylinder.
Figure 6:
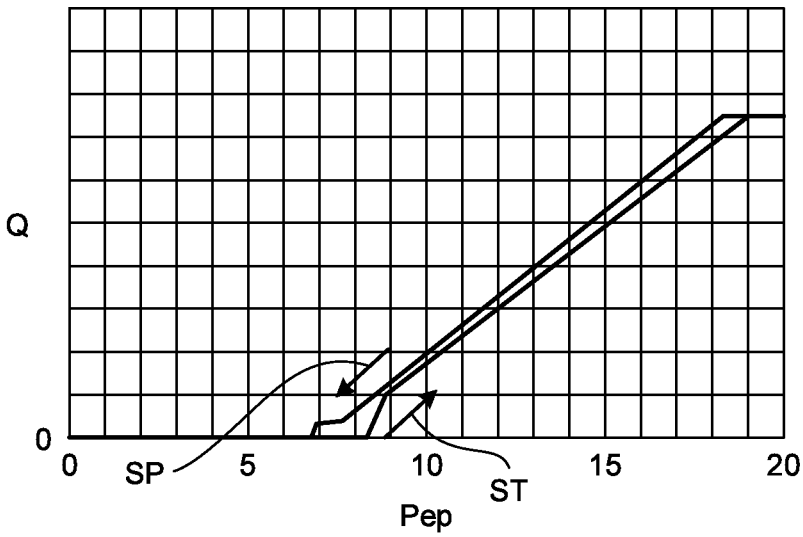
FIG. 6 is a diagram illustrating a relation between a piston chamber pressure of the pump capacity control cylinder and a flow rate Q of hydraulic oil discharged from the HST pump.
Figure 7:
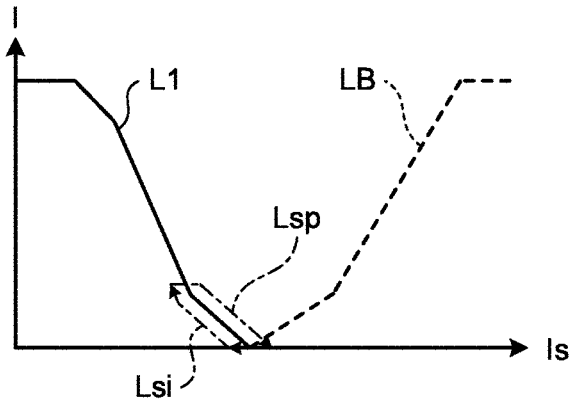
FIG. 7 is a diagram for illustrating the characteristics when the inching rate changes.

FIG. 5 is a diagram illustrating a relation between a command signal iep applied to the pump electromagnetic proportional control valve for controlling the HST pump 10 and a piston chamber pressure Pep of the pump capacity control cylinder 14. FIG. 6 is a diagram illustrating a relation between the piston chamber pressure Pep of the pump capacity control cylinder 14 and a flow rate Q of the hydraulic oil discharged from the HST pump 10. FIG. 7 is a diagram illustrating characteristics when the inching rate I changes. The pump electromagnetic proportional control valves are the forward pump electromagnetic proportional control valve 12 and the reverse pump electromagnetic proportional control valve 13 illustrated in FIG. 2. The piston chamber pressure Pep is a pressure of the hydraulic oil supplied to a space between the cylinder case 14C and the piston 14*a* of the pump capacity control cylinder 14 illustrated in FIG. 2.

An arrow ST of FIGS. 5 and 6 indicates a change when the flow rate of the hydraulic oil discharged from the HST pump 10 illustrated in FIG. 2 increases, and an arrow SP indicates a change when the flow rate of the hydraulic oil discharged from the HST pump 10 decreases. As illustrated in FIG. 5, when the command signal iep applied to the pump electromagnetic proportional control valve increases, the piston chamber pressure Pep increases, and as illustrated in FIG. 6, the flow rate Q of the hydraulic oil discharged from the HST pump 10 increases. When the command signal ipe decreases, the piston chamber pressure Pep decreases, and as illustrated in FIG. 6, the flow rate Q of the hydraulic oil discharged from the HST pump 10 decreases.

As illustrated in FIG. 5, a route of an increase in the piston chamber pressure Pep when the command signal iep increases is different from a route of a decrease in the piston chamber pressure Pep when the command signal iep decreases. For this reason, as illustrated in FIG. 6, a route of an increase in the flow rate Q when the piston chamber pressure Pep increases is different from a route of a decrease in the flow rate Q when the piston chamber pressure Pep decreases. Thus, the change in the flow rate Q of the hydraulic oil discharged from the HST pump 10 has hysteresis characteristics.

A case where the inching rate I increases corresponds to a case where the flow rate Q of the hydraulic oil discharged from the HST pump 10 increases, and a case where the inching rate I decreases corresponding to a case where the flow rate Q of the hydraulic oil discharged from the HST pump 10 decreases. In FIG. 7, the route when the inching rate I decreases is Lsp, and the route when the inching rate I increases is Lsi. As described above, since the flow rate Q of the hydraulic oil discharged from the HST pump 10 changes with the hysteresis characteristics, as illustrated in FIG. 7, a change in the inching rate I with respect to the inching operation amount Is also has the hysteresis characteristics.

In the case where the inching rate I decreases and in the case where the inching rate I increases, points where the route Lsp and the route Lsi of the inching rate I intersect with the horizontal axis are different from each other. For this reason, in the case of stepping on the inching pedal 40*a* to stop the forklift 1, and in the case of releasing the inching pedal 40*a* to start the forklift 1, the positions of the inching pedal 40*a* are different from each other. Specifically, when the forklift 1 stops, the inching pedal 40*a* is stepped on more than when the forklift 1 starts. Thus, in the latter case, a position of the inching pedal 40*a* becomes a front side, that is, an operator side.

For example, the operator releases the inching pedal 40*a* little by little from the state of slightly stepping on the accelerator pedal 41*a* to start the forklift 1 at a very slow speed. Moreover, when the operator steps on the inching pedal 40*a* to stop the forklift 1 at a target position, the forklift 1 stops at a position deeper than a stroke of the inching pedal 40*a* when the forklift 1 starts, that is, at a position where the inching pedal 40*a* is away from the operator. Thus, the operator is hard to finely adjust the stop position of the forklift 1 by the operation of the inching pedal 40*a* in the state of slightly stepping on the accelerator pedal 41*a*, and in the state of stepping on the inching pedal 40*a*. As described above, this is caused by the fact that the flow rate Q of the hydraulic oil discharged from the HST pump 10 changes with a hysteresis characteristic, with the result that a change in the inching rate I with respect to the inching operation amount Is also has the hysteresis characteristic.

As described above, the forklift 1 according to the invention is configured so that a lower limit of the inching rate I is kept in a minimum inching rate Im in the simultaneous operation state. Thus, when the inching operation amount Is increases, since the inching rate I is not smaller than the minimum inching rate Im, in the simultaneous operation state, the HST pump 10 discharges the hydraulic oil of the flow rate Q corresponding to the minimum inching rate Im to generate the driving force. For this reason, the forklift 1 can maintain the minimum driving force. As a result, in the simultaneous operation state, when stopping the start by the braking force of the mechanical brake, it is possible to reduce the time lag at the time of start. Furthermore, in the simultaneous operation state, since the HST pump 10 discharges the hydraulic oil of the flow rate Q corresponding to the minimum inching rate Im, when the braking force of the mechanical brake disappears, the driving force of the HST pump 10 is rapidly transmitted to the driving wheels 2*a* illustrated in FIG. 1. As a result, since it is possible to reduce the influence of the hysteresis characteristics when the inching rate I changes, it is possible to suppress a change in the stroke of the inching pedal 40*a* at the time of start and stop of the forklift 1. Therefore, it is possible to improve operability when finely adjusting the stop position of the forklift 1.

In the forklift 1, in states other than the simultaneous operation state, that is, when the inching pedal 40*a* is operated alone, both of the inching rate I and the mechanical brake rate B become 0% in the same inching operation amount Is. Therefore, it is possible to avoid consumption of the driving force of the HST pump 10 in the braking force of the mechanical brake. As a result, the forklift 1 can minimize losses due to maintaining of the lower limit of the inching rate I in a minimum ratio Im, and degradation of fuel efficiency caused by the losses.

In addition, even if an overlap region where both of the inching rate I and the mechanical brake rate B become 0% or more is provided, it is possible to reduce the influence of the hysteresis characteristics when the inching rate I changes. However, there is a possibility that the provision of the overlap region may lead to degradation of the fuel efficiency. This embodiment can reduce the influence of the hysteresis characteristics when the inching rate I changes, without providing an overlap region. Therefore, it is possible to suppress the change in the stroke of the inching pedal 40*a* at the time of start and stop of the forklift 1 and to minimize the degradation of the fuel efficiency.

Figure 8:
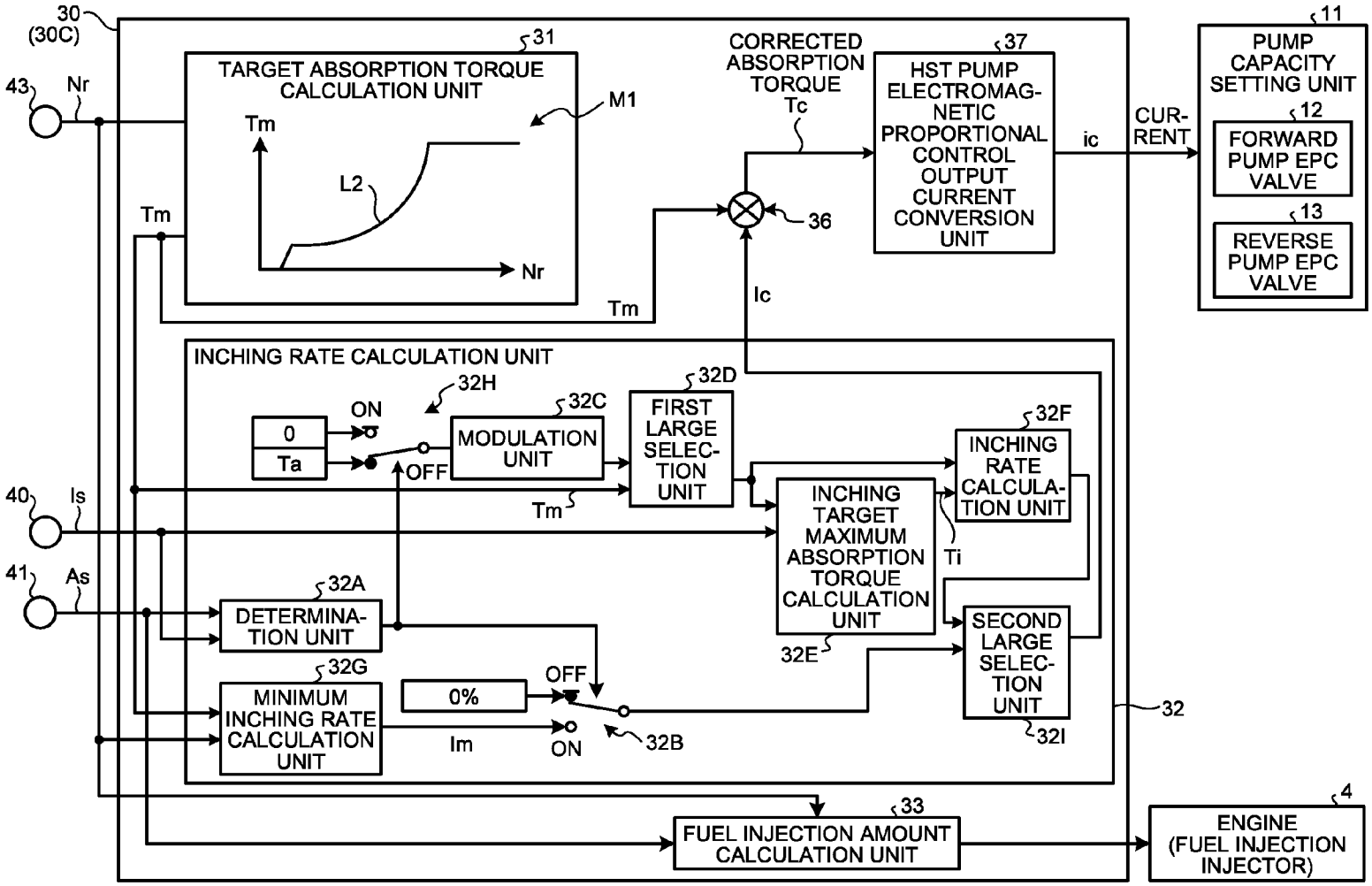
FIG. 8 is a block diagram illustrating pump control including inching control of the HST pump using a control device.
Figures 9, 10:
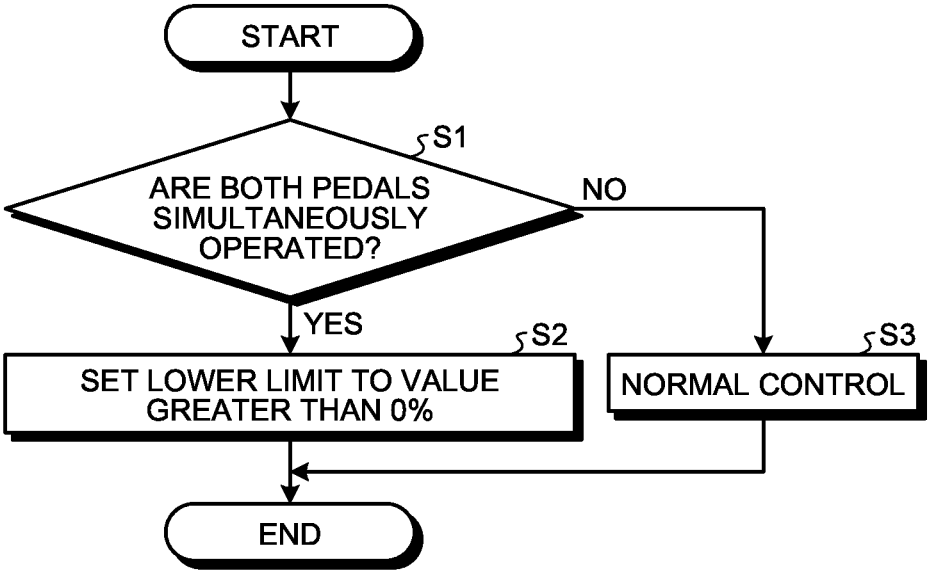
FIG. 9 is a diagram illustrating an example of a map used in seeking an inching target maximum absorption torque.
FIG. 10 is a flow chart illustrating a control example of the inching rate in a simultaneous operation state.

FIG. 8 is a block diagram illustrating pump control including inching control of the HST pump 10 using the control device 30. FIG. 9 is a diagram illustrating an example of a map MP used when seeking the inching target maximum absorption torque. As illustrated in FIG. 8, the control device 30 includes a target absorption torque calculation unit 31, an inching rate calculation unit 32, a fuel injection amount calculation unit 33, and an HST pump electromagnetic proportional control output current conversion unit 37.

The target absorption torque calculation unit 31 calculates a target absorption torque Tm of the HST pump 10, based on an actual engine speed (actual engine rotational speed) Nr detected by the engine speed sensor 43. The target absorption torque calculation unit 31 has a map M1 indicating the characteristics of the target absorption torque Tm with respect to the actual engine speed Nr. The target absorption torque calculation unit 31 calculates the target absorption torque Tm corresponding to the input actual engine speed Nr, based on a relation between the actual engine speed Nr and the target absorption torque Tm as indicated by the characteristic line L2 on the map M1, and outputs the target absorption torque Tm to a multiplication unit 36 and the inching rate calculation unit 32. For example, the characteristic line L2 is defined so that the fuel consumption rate of the engine 4 illustrated in FIG. 2 is minimized.

The inching rate calculation unit 32 includes a determination unit 32A, a first switching unit 32B, a modulation unit 32C, a first large selection unit 32D, an inching target maximum absorption torque calculation unit 32E, an inching rate calculation unit 32F, a minimum inching rate calculation unit 32G, a second switching unit 32H, and a second large selection unit 32I. The determination unit 32A determines whether or not both pedals are in the simultaneous operation state. For this reason, the determination unit 32A obtains an inching operation amount Is and an accelerator opening As from the inching potentiometer 40 and the accelerator potentiometer 41, respectively.

When the inching operation amount Is is a first predetermined threshold value or more and the accelerator opening As is a second predetermined threshold value or more, the determination unit 32A determines that both pedals are in the simultaneous operation state to switch the first switching unit 32B and the second switching unit 32H to an ON side. In this way, the minimum inching rate Im as a calculation result of the minimum inching rate calculation unit 32G is output from the first switching unit 32B. 0% is output as the absorption torque of the HST pump 10 from the second switching unit 32H.

When conditions, in which the inching operation amount Is is a first predetermined threshold value or more and the accelerator opening As is a second predetermined threshold value or more, are not satisfied, the determination unit 32A switches the first switching unit 32B and the second switching unit 32H to an OFF side. In this way, 0% is output as the inching rate I from the first switching unit 32B. Ta is output as the absorption torque of the HST pump 10 from the second switching unit 32H.

If both pedals are not in the simultaneous operation state, Ta is output as the absorption torque of the HST pump 10 from the second switching unit 32H, but during deceleration by operating the inching pedal 40*a* alone in a state in which the absorption torque of the HST pump 10 is Ta (for example, approximately 5 kgf·m) or less, the accelerator pedal 41*a* may be stepped on. In this case, since the inching rate I increases by an inching target maximum absorption torque Ti during inching obtained by the inching target maximum absorption torque calculation unit 32E and the forklift 1 is accelerated, the feeling of acceleration is relieved by the modulation unit 32C. When the second switching unit 32H is turned ON from OFF, the modulation unit 32C executes the modulation, and when the second switching unit 32H is turned ON from OFF, the modulation unit 32C does not apply the modulation.

The large selection unit 32D compares the output of the modulation unit 32C with the target maximum absorption torque Tm output from the target absorption torque calculation unit 31, and outputs the larger output. The selection result of the large selection unit 32D is input to the inching target maximum absorption torque calculation unit 32E and the inching rate calculation unit 32F. For example, the inching target maximum absorption torque calculation unit 32E calculates the inching target maximum absorption torque Ti based on the map MP illustrated in FIG. 9.

In the map MP, inching target maximum absorption torques Tia, Tib, . . . Tix determined in advance depending on inching operation amounts Is1, Is2, . . . Isn−1, Isn (%) and maximum absorption torques Tmx1, Tmx2, . . . Tmxk are described. Numerical values and alphabets attached to the symbols are added to identify the inching operation amounts Is1, Is2, . . . Isn−1, Isn, a plurality of maximum absorption torques Tmx1, Tmx2, . . . Tmxk or the like. If the identification is not required, they are referred to as an inching operation amount Is, a maximum absorption torque Tmx, and an inching target maximum absorption torque Ti. Symbols n and k are integers of 1 or more.

When the inching operation amount Is becomes a predetermined magnitude or more, the inching target maximum absorption torque Ti becomes 0. When the inching operation amount Is is less than a predetermined magnitude, if the inching operation amount Is is the same, the inching target maximum absorption torque Ti becomes greater as the maximum absorption torque Tmx increases. When the maximum absorption torque Tmx is the same, the inching target maximum absorption torque Ti becomes smaller as the inching operation amount Is increases.

The inching target maximum absorption torque calculation unit 32E obtains the inching operation amount Is from the inching potentiometer 40 and the output from the first large selection unit 32D. In the simultaneous operation state, the target absorption torque Tm obtained from the target absorption torque calculation unit 31 is output from the large selection unit 32D. For this reason, in the simultaneous operation state, the inching target maximum absorption torque calculation unit 32E applies the target absorption torque Tm to the map MP as the maximum absorption torque Tmx. At the same time, the inching target maximum absorption torque calculation unit 32E applies the inching operation amount Is obtained from the inching potentiometer 40 to the map MP, thereby seeking the corresponding inching target maximum absorption torque Ti. Thus, by seeking the inching target maximum absorption torque Ti from the target absorption torque Tm and the inching operation amount Is, it is possible to appropriately change the vehicle speed of the forklift 1 in the simultaneous operation state, thereby improving the operability of the forklift 1.

The inching rate calculation unit 32F obtains the output from the first large selection unit 32D and the inching target maximum absorption torque Ti sought by the inching target maximum absorption torque calculation unit 32E, and calculates the inching rate I using them. In the simultaneous operation state, the target absorption torque Tm obtained from the target absorption torque calculation unit 31 is output from the large selection unit 32D. Therefore, the inching rate I [%] can be sought by Formula (1).

$$I=Ti/Tm\times 100 \quad (1)$$

The minimum inching rate calculation unit 32G seeks the minimum inching rate Im from the target absorption torque Tm sought by the target absorption torque calculation unit 31 and the actual engine speed Nr obtained from the engine speed sensor 43. In this embodiment, the minimum inching rate Im [%] may be sought by Formula (2). Kn is a coefficient and changes depending on the actual engine speed Nr. In this embodiment, Kn is a value that is greater in a case of a low actual engine speed Nr than in a case of a high actual engine speed Nr.

$$Im=Kn/Nr/Tm\times 100 \quad (2)$$

From Formula (2), when horsepower (power) output from the engine 4 or absorption horsepower (power) of the HST pump 10 increases, the minimum inching rate Im decreases, and when horsepower output from the engine 4 or absorption horsepower of the HST pump 10 decreases, the minimum inching rate Im increases. When the minimum inching rate Im is the same and the output of the engine 4 increases in the simultaneous operation state, an absolute value of the output of the engine 4 distributed to the HST pump 10 increases. When releasing the inching pedal 40*a* in this state, there is a possibility that the forklift 1 may suddenly start. Furthermore, when the minimum inching rate Im is the same and the output of the engine 4 decreases in the simultaneous operation state, the absolute value of the output of the engine 4 distributed to the HST pump 10 decreases. When releasing the inching pedal 40*a* in this state, there is a possibility that slowness may occur even when starting the forklift 1.

Since the minimum inching rate Im is determined based on the actual engine speed Nr and the target absorption torque Tm sought by the actual engine speed Nr, in this embodiment, it is possible to obtain a suitable inching ratio I depending on a change in the output of the engine 4. As a result, a decrease in operability when causing the forklift 1 to travel at a very slow speed in the simultaneous operation state is suppressed. Furthermore, by determining the minimum inching rate Im as described above, it is possible to minimize losses due to generation of the driving force by the HST pump 10, and to maintain a constant stroke of the inching pedal 40*a* when the forklift 1 begins to move, irrespective of the magnitude of the target absorption torque Tm.

The inching rate I sought by the inching rate calculation unit 32F and the minimum inching rate Im sought by the minimum inching rate calculation unit 32G are input to the second large selection unit 32I. The second large selection unit 32I compares the inching rate I with the minimum inching rate Im, and outputs the larger inching rate to the multiplication unit 36 as a corrected inching rate Ic. As illustrated in FIG. 3, when the inching rate I sought by the inching rate calculation unit 32F decreases by an increase in the inching operation amount Is, the minimum inching rate Im becomes larger than the inching rate I. Then, the second large selection unit 32I outputs the minimum inching rate Im to the multiplication unit 36 as a corrected inching rate Ic.

The multiplication unit 36 multiplies the target absorption torque Tm by the corrected inching rate Ic. Moreover, the multiplication unit 36 outputs the corrected absorption torque Tc obtained by reducing the target absorption torque Tm in response to the corrected inching rate Ic to the HST pump electromagnetic proportional control output current conversion unit 37.

The HST pump electromagnetic proportional control output current conversion unit 37 as an output control unit generates the corrected absorption torque command is obtained by reducing the target absorption torque Tm by the corrected inching rate Ic, and outputs the command to the pump capacity setting unit 11 of the HST pump 10.

The corrected absorption torque command ic is a signal (a current value in this embodiment) for converting the torque to be absorbed by the HST pump 10 into the corrected absorption torque Tc that is output from the multiplication unit 36. The corrected absorption torque command ic is output to the forward pump electromagnetic proportional control valve 12 or the reverse pump electromagnetic proportional control valve 13 of the pump capacity setting unit 11 from the HST pump electromagnetic proportional control output current conversion unit 37.

The fuel injection amount calculation unit 33 calculates an amount to be injected into a fuel injection injector of the engine 4, based on the actual engine speed Nr to be input and the accelerator opening As, and outputs the results thereof to the fuel injection injector. Next, a control example of the inching rate I in the simultaneous operation state will be briefly described.

Control Example

FIG. 10 is a flowchart illustrating a control example of the inching rate I in the simultaneous operation state. In Step S1, the determination unit 32A of the control device 30 illustrated in FIG. 8 determines whether or not both pedals are in the simultaneous operation state. When both pedals are in the simultaneous operation state (Yes in Step S1), the determination unit 32A turns the first switching unit 32B and the second switching unit 32H ON. By this operation, in Step S2, the lower limit of the inching rate I becomes the minimum inching rate Im greater than 0 [%]. When both pedals are not in the simultaneous operation state (No in Step S1), the determination unit 32A turns the first switching unit 32B and the second switching unit 32H OFF. By this operation, in Step S3, the inching rate I changes to a normal state, for example, according to the characteristic line L1 in FIG. 3 in which the lower limit of the inching rate I becomes 0 [%].

In this embodiment, the target absorption torque is sought by the target absorption torque calculation unit 31, but the term "target absorption torque" is only one concept and it may be a target swash plate tilting angle. The target swash plate tilting angle is a targeted tilting angle of the swash plate included in the HST pump 10 illustrated in FIG. 2. In this case, the HST pump 10 is controlled by a corrected swash plate tilting angle command corresponding to a corrected swash plate tilting angle in which the target swash plate tilting angle sought by the target absorption torque calculation unit 32 decreases, based on the corrected inching rate Ic sought by the inching rate calculation unit 32. In addition, an inching target maximum swash plate tilting angle may be used instead of the above-described inching target maximum absorption torque.

The embodiment has been described above, but the embodiment is not limited by the foregoing description. Furthermore, the above-described components include components capable of being easily assumed by an ordinary person skilled in the art, components that are substantially the same, and so-called components within the range of equivalents. Furthermore, the above-described components can be appropriately combined. In addition, it is possible to perform at least one of various omissions, substitutions, and modifications without departing from the scope of the embodiment.

REFERENCE SIGNS LIST

1 FORKLIFT
4 ENGINE
6 FORK
10 TRAVELING HYDRAULIC PUMP (HST PUMP)
11 PUMP CAPACITY SETTING UNIT
12 FORWARD PUMP ELECTROMAGNETIC PROPORTIONAL CONTROL VALVE
13 REVERSE PUMP ELECTROMAGNETIC PROPORTIONAL CONTROL VALVE
14 PUMP CAPACITY CONTROL CYLINDER
20 HYDRAULIC MOTOR (HST MOTOR)
30 CONTROL DEVICE
31 TARGET ABSORPTION TORQUE CALCULATION UNIT
32 INCHING RATE CALCULATION UNIT
32A DETERMINATION UNIT
32B FIRST SWITCHING UNIT
32C MODULATION UNIT
32D FIRST LARGE SELECTION UNIT
32E INCHING TARGET MAXIMUM ABSORPTION TORQUE CALCULATION UNIT
32F INCHING RATE CALCULATION UNIT
32G MINIMUM INCHING RATE CALCULATION UNIT
32H SECOND SWITCHING UNIT
32I SECOND LARGE SELECTION UNIT
33 FUEL INJECTION AMOUNT CALCULATION UNIT
36 MULTIPLICATION UNIT
37 HST PUMP ELECTROMAGNETIC PROPORTIONAL CONTROL OUTPUT CURRENT CONVERSION UNIT
40 INCHING POTENTIOMETER
40*a* INCHING PEDAL
41 ACCELERATOR POTENTIOMETER
41*a* ACCELERATOR PEDAL
43 ENGINE SPEED SENSOR
100 MAIN HYDRAULIC CIRCUIT
As ACCELERATOR OPENING
B MECHANICAL BRAKE RATE
I INCHING RATE
Im MINIMUM INCHING RATE
Is INCHING OPERATION AMOUNT
Ti INCHING TARGET MAXIMUM ABSORPTION TORQUE

The invention claimed is:

1. A forklift comprising:

a variable displacement traveling hydraulic pump driven by an engine;

a hydraulic motor that forms a closed circuit with the traveling hydraulic pump therebetween and is driven by hydraulic oil discharged from the traveling hydraulic pump;

driving wheels driven by the hydraulic motor;

an accelerator operation unit that increases and decreases an amount of fuel supplied to the engine;

a target absorption torque calculation unit that calculates a target absorption torque of the traveling hydraulic pump or a target swash plate tilting angle of a swash plate included in the traveling hydraulic pump, based on an actual engine speed of the engine;

an inching operation unit that operates an inching rate indicating a reduction ratio to a predetermined swash plate tilting angle of the traveling hydraulic pump;

an inching rate calculation unit that calculates the inching rate corresponding to an operation amount of the inching operation unit, and sets a lower limit of the inching rate to a value greater than 0, only in a state in which both of the accelerator operation unit and the inching operation unit are operated; and an output control unit that outputs a corrected absorption torque command corresponding to a corrected absorption torque obtained by reducing the target absorption torque based on the inching rate or a corrected swash plate tilting angle command corresponding to a corrected swash plate tilting angle obtained by reducing the target swash plate tilting angle based on the inching rate to the traveling hydraulic pump.

2. The forklift according to claim 1, wherein the lower limit of the inching rate is determined based on a rotational speed of the engine, and a target absorption torque of the traveling hydraulic pump determined from the rotational speed of the engine.

3. The forklift according to claim 2, wherein the lower limit of the inching rate is determined depending on horsepower output from the engine or absorption horsepower of the traveling hydraulic pump.

4. A method of controlling a forklift including a variable displacement traveling hydraulic pump driven by an engine, a hydraulic motor that forms a closed circuit with the traveling hydraulic pump therebetween and is driven by hydraulic oil discharged from the traveling hydraulic pump, driving wheels driven by the hydraulic motor, an accelerator operation unit that increases and decreases an amount of fuel supplied to the engine, and an inching operation unit that operates an inching rate indicating a reduction ratio to a predetermined swash plate tilting angle of the traveling hydraulic pump, the method comprising:

calculating the inching rate corresponding to the operation amount of the inching operation unit, and setting a lower limit of the inching rate to a value greater than 0, only in a state in which both of the accelerator operation unit and the inching operation unit are operated; and outputting a corrected absorption torque command corresponding to a corrected absorption torque obtained by reducing a target absorption torque of the traveling hydraulic pump based on the inching rate, or a corrected swash plate tilting angle command corresponding to a corrected swash plate tilting angle obtained by reducing a target swash plate tilting angle of a swash plate included in the traveling hydraulic pump based on the inching rate, to the traveling hydraulic pump.

5. The method of controlling a forklift according to claim 4, wherein a lower limit of the inching rate is determined based on a rotational speed of the engine, and a target absorption torque of the traveling hydraulic pump determined from the rotational speed of the engine.

6. The method of controlling a forklift according to claim 5, wherein the lower limit of the inching rate is determined depending on horsepower output from the engine or absorption horsepower of the traveling hydraulic pump.

* * * * *